United States Patent [19]

LaForce

[11] 4,020,811

[45] May 3, 1977

[54] RECIRCULATING FUEL FEED AND VAPORIZATION APPARATUS AND METHOD

[75] Inventor: Edward P. LaForce, Huntington, Vt.

[73] Assignee: Ventur-E, Inc. of Richmond, Richmond, Vt.

[22] Filed: Nov. 18, 1974

[21] Appl. No.: 524,992

[52] U.S. Cl. ..... 123/122 AC; 123/133; 123/122 AB; 123/122 H; 123/141; 261/DIG. 55; 261/DIG. 21

[51] Int. Cl.[2] ..... F02M 31/00

[58] Field of Search ..... 123/122 AC, 122 AB, 123/133, 124 R, 122 AA, 122 R, 122 H, 141; 261/DIG. 55, DIG. 21, 145; 165/52

[56] References Cited

UNITED STATES PATENTS

| | | | |
|---|---|---|---|
| 650,736 | 5/1900 | Sutton | 123/141 |
| 2,745,394 | 5/1956 | Holley | 123/122 AC |
| 3,618,577 | 11/1971 | Shaw | 123/122 AC |
| 3,892,213 | 7/1975 | Cole | 123/122 AC |

FOREIGN PATENTS OR APPLICATIONS

| | | | |
|---|---|---|---|
| 1,019,861 | 11/1957 | Germany | 123/141 |

OTHER PUBLICATIONS

J. C. Whitney, (1973) p. 133, "Tuned Header Dual Exhaust for Datsun 240Z".

*Primary Examiner*—Ronald H. Lazarus
*Attorney, Agent, or Firm*—Parmelee, Johnson & Bollinger

[57] ABSTRACT

There is disclosed an apparatus for ensuring maximum vaporization of fuel before entry into the intake manifold of an internal combustion engine. The apparatus comprises an extension of the carburetor which separates vaporized fuel from droplets of fuel which remain unvaporized or which are condensed before entering the intake manifold. The unvaporized fuel is collected and subjected to heat generated at the engine exhaust pipe. In particular, heated ambient air heats and vaporizes the unvaporized fuel. The thusly vaporized fuel is then re-introduced into the fuel-air mixture exiting the carburetor, and subsequently enters the intake manifold.

29 Claims, 5 Drawing Figures

12
65
65
61
67
14
60
30
20
54
92
90
70
50
16
96
91
86
89
94
62
69
10
98
84
72
34
74
32
48
81
16b
80
82
78
38
76
36
122
124
44
102
100
104
126
46
42
40
120
16a

RECIRCULATING FUEL FEED AND VAPORIZATION APPARATUS AND METHOD

BACKGROUND OF THE INVENTION

The present invention relates to an apparatus for treating fuel prior to entry into the intake manifold of an internal combustion engine, and more particularly to an apparatus for gasifying that portion of the fuel which will not vaporize under normal conditions, or which most readily condenses once vaporized.

Unvaporized or ungasified portions of fuel normally do not burn within the cylinder and are lost to the combustion process and so wasted. The greatest portion of this unburned (wasted) fuel is not sufficiently volatile to gasify in the time spent within the cylinders. As the wasted fuel passes through the engine to the exhaust, some marginal parts appear in an exhaust gas analysis as partially burned carbon monoxide (CO). Other marginal parts appear as unburned hydrocarbons (HC). While detecting some of the unburned products ordinary exhust gas analysis procedures do not detect a great portion of these unburned fuel constituents. The residual heavy varnishes and tars associated with the unburned portions of fuel recondense and drop out of the exhaust gas samples and thus fail to register as pollutants which are normally discharged by the exhaust pipe to the atmosphere.

Mechanical designers have long been concerned with developing an efficiently operating internal combustion engine. In the United States, the automobile is reponsible for a significant percentage of pollutants found in the atmosphere, and the consumption of vast amounts of the petroleum available in this country. Accordingly, automobile engine designers have expended considerable efforts to reduce the fuel consumption and pollution-developing characteristics of internal combustion engines. This interest has led to various engine designs, many of which have achieved some success. However, there remains the need for more efficient engines.

In addition to the engine designs themselves, automotive engineers have proposed various devices for use with internal combustion engines to increase engine efficiency. This equipment is frequently directed to improving the efficiency of the engine combustion phase, such as ignition systems, pre-heaters, and the like, Again, some of this apparatus has experienced success, but none has made a significant advance in the field.

Other proposals for increasing combustion efficiency have included the redesign of the combustion and/or the engine carburetor. Redesign of the carburetor improves engine combustion and mechanical efficiency by improving the uniformity and quality of the fuel-air mixture entering the several engine combustion chambers. For example, combustion efficiency has to some extent been improved by increasing fuel vaporization by means of devices such as centrifugal separators, charge stratifiers, screens placed in the flow lines, etc. While there may be some improvement in engine efficiency by using these devices, other problems may arise such as unreliability and non-uniformity of operation, especially during cold-engine operation or during periods of high acceleration. Furthermore, such devices are often difficult to control, making these devices of marginal value at best.

A serious drawback to the above-discussed known fuel vaporization device is the inability to adequately operate on the heavy ends of modern fuels, that is, those fuel components having the high molecular weight. Heavy ends atomize sufficiently to pass through an engine but do not readily vaporize. Therefore, unless specially handled, the heavy ends will be entrained in the fuel-air mixture entering the engine combustion chamber with resulting combustion inefficiencies. The devices discussed above, often provide a mechanism for removing some of the heavy ends from the fuel-air mixture, but do not utilize these heavy ends when removed. Such known devices are therefore wasteful and inefficient.

One known method for vaporizing heavy ends has been to heat the fuel or the fuel-air mixture. While this method is potentially effective, it has not been entirely successful because the complex composition of modern fuels makes it difficult to provide a simple device which vaporizes all of the heavy ends present in a given fuel/-without overheating the air in which the fuel is entrained. Furthermore, an engine may at different times be used with a variety of fuels, thus making a fixed temperature heating system inefficient. One known device operates at temperatures high enough to vaporize all heavy ends in the fuel. This device is at best wasteful of energy, and may even be dangerous from a standpoint of risking a high temperature explosion. As a compromise, devices have been developed which generate a type of "average temperature", with a resultant efficient vaporization of only some, but not all of the heavy ends.

Other presently known vaporizing devices operate at less than maximum performance as a result of heat loss in the vaporized fuel flowing back into the mainstream of the engine fuel-air mixture. Reliquification of the heavy ends due to such heat loss would tend to negate the effect of the vaporizing device. There could also result a fuel-air mixture which varies in quality among the engine cylinders, with only those cylinders located near the device receiving fully vaporized fuel and uniform mixtures. Such non-uniformity in mixture would cause engine control problems as well as engine efficiency losses.

Therefore, to assure efficient, safe engine operating, the heat output of a fuel vaporizer must be carefully controlled so as to heat the heavy ends in an atmosphere too rich to burn while heating. It is this lack of control which is most likely responsible for the inefficient, ineffective and potentially dangerous operation of known devices. Such inefficiency and/or ineffectiveness presents serious doubts to the future use of these known fuel vaporizing devices as the solution to the problem of improving the performance of internal combustion engines.

Recently, strict exhaust pollution level constraints have been placed on modern internal combustion engines in general, and on automobile engines in particular. Most modern pollution control devices treat engine exhaust and therefore are directed at curing the symptoms of inefficient combustion rather than the causes. Thus, while pollution levels are decreased, automobile costs and fuel consumption are increased.

The exhaust from automobile engines generally contains hydrocarbon, carbon monoxide and oxides of nitrogen such as nitric oxide and nitrous oxide. Modern pollution control devices such as the catalytic converter help to control the hydrocarbon and carbon monoxide levels, but do not effectively control the nitrogen oxide levels in engine exhausts. Therefore, pollution from engine exhausts remains a serious problem.

The drawbacks of the piston-type internal combustion engine which are discussed above have to some extent recently resulted in the commercialization of the long-known rotary engine. Some of the problems characteristic of the piston engine have been overcome, yet the rotary engine suffers from its own drawbacks. As an example, the piston engine runs relatively hot, and hence nitrous oxide is formed. Yet the piston engine is low in its carbon monoxide and hydrocarbon levels. The rotary engine, on the other hand, runs cooler and hence the level of nitrous oxide is low. However, the levels of carbon monoxide and hydrocarbon are high. Fuel consumption is also high due to low expansion ratios. It should be apparent from the above, that the problem of exhaust pollution has by no means been overcome.

While some presently known devices are directed to the problem of providing efficient combustion, and other devices purportedly provide exhaust pollution control, there are no known engines and no known devices which provide efficient engine operation under normal engine conditions. Therefore, a great need exists for a device which effectively enhances both the operating efficiency and the freedom from exhaust pollution in an internal combustion engine.

The present invention relates to an internal combustion engine provided with a recirculating fuel-feed mechanism for increasing the efficiency of the combustion phases of the internal combustion engine by ensuring complete vaporization of the fuel entering the intake manifold. As such, the power developed by the engine is increased, and the level of pollutants is reduced.

SUMMARY OF THE INVENTION

Briefly, the present invention relates to an apparatus for use in an internal combustion engine for vaporizing fuel heavy ends which would otherwise enter the intake manifold and hence the cylinders in a liquid state. The apparatus comprises a carburetor extension for delivering vaporized fuel to the intake manifold and for directing the flow of unvaporized fuel toward a heated collecting chamber which is energized by heat from the engine exhaust. In a preferred embodiment of the invention, two heater stages are provided to ensure total vaporization of the fuel heavy ends, with the outlet of the recirculating fuel-feed system feeding into the main stream of the carburetor fuel-air mixture just prior to introduction to the intake manifold.

The mechansim for heat transfer utilized in the first heater stage comprises a continuous spiral groove in an outer surface of the engine exhaust pipe. The groove retains the unatomized liquid fuel in intimate contact with the heat source until the fuel is vaporized.

The second heater stage is downstream of the first, and is positioned near a location where the atomized recirculated fuel is introduced into the intake manifold of the engine. Thus, any heat loss undergone by the vaporized fuel flowing from the first to the second stage is replaced by the second heater stage. A uniformly vaporized fuel is thus delivered to the cylinders of an engine by way of the present invention. Additional heaters can be strategically positioned in an engine to maximize the uniformity of the fuel-air mixture flowing into the engine intake manifold and to all engine cylinders.

The present invention also relates to the method of vaporizing unvaporized heavy ends prior to entering the manifold of an engine. The inventive method comprises the steps of separating the unvaporized from the vaporized fuel, collecting the unvaporized fuel, preheating the thus collected fuel in a first heater stage using heat from the engine exhaust, directing the vapor thus formed to flow through a further heater stage downstream of the first to ensure complete vaporization, and introducing the vapor into the fuel-air mixture exiting the engine carburetor.

While the apparatus of the present invention can be used with any internal combustion engine, it is contemplated that the invention be used on an engine having a high expansion ratio. Such a high expansion ratio engine is disclosed in co-pending U.S. patent application Ser. No. 427,048, filed Dec. 21, 1973 now abandoned and entitled Internal Combustion Engines. The present invention results in a rapid and substantially complete fuel explosion. Such an explosion is best suited for use in the high expansion ratio engine which operates most efficiently best with rapid fuel explosion and which offers a rate of expansion sufficiently rapid to hold combustion temperatures well below the critical limits known to produce knock and the contaminant, nitrous oxide.

An engine having a dual exhaust pipe is another advantageous application for the apparatus of the present invention. Scavenging is the process of removing burned gases from an internal combustion engine. Therefore, efficient scavenging of an engine will result in an increase in engine power and performance. Exhaust from certain cylinders may interfere with the functioning of other cylinders in single exhaust engines. A dual exhaust manifold engine overcomes this drawback by exhausting alternately firing cylinders in alternate sections of the exhaust manifold.

With the present invention, substantially uniform fuel-air mixtures are fed to all cylinders. As such, the richness of the mixture need not be balanced to compromise engine performance, a step necessitated by the common unevenness of mixture in different cylinders. In addition, the uniform and fully vaporized nature of the fuel-air mixture in the cylinders results in substantially complete burning in the cylinders. Therefore, the present invention brings about a low level of nitrous oxide carbon monoxide and hydrocarbons as well.

It is accordingly a broad object of the present invention to provide a mechanism to increase the efficiency of an engine.

A further object of the present invention is to efficienctly reduce the amount of unvaporized fuel entering the intake manifold of an engine.

Yet a further object of the present invention is to improve the operating efficiency of an internal combustion engine.

Another object of the present invention is to provide improved control over the fuel-air mixture entering an engine intake manifold.

Yet another object of the present invention is to reduce the level of pollutants found in the exhaust of an internal combustion engine.

Yet a further object of the present invention is to provide a uniform fuel-air mixture to all cylinders of an internal combustion engine.

Still a further object of the present invention is to vaporize fuel heavy ends without producing excess heat in the carburetor/air or/hot spots in the combustion chambers of an internal combustion engine.

A further object of the present invention is to recycle unvaporized fuel prior to entry into the intake manifold until such fuel is fully vaporized.

Yet a further object of the present invention is to improve engine scavengine.

These and other objects of the present invention, as well as many of the attendant advantages thereof, will become more readily apparent when reference is made to the following description taken in conjuction with the accompanying drawings.

DETAILED DESCRIPTION OF THE PREFERRED EMBODIMENTS

Figure 1:
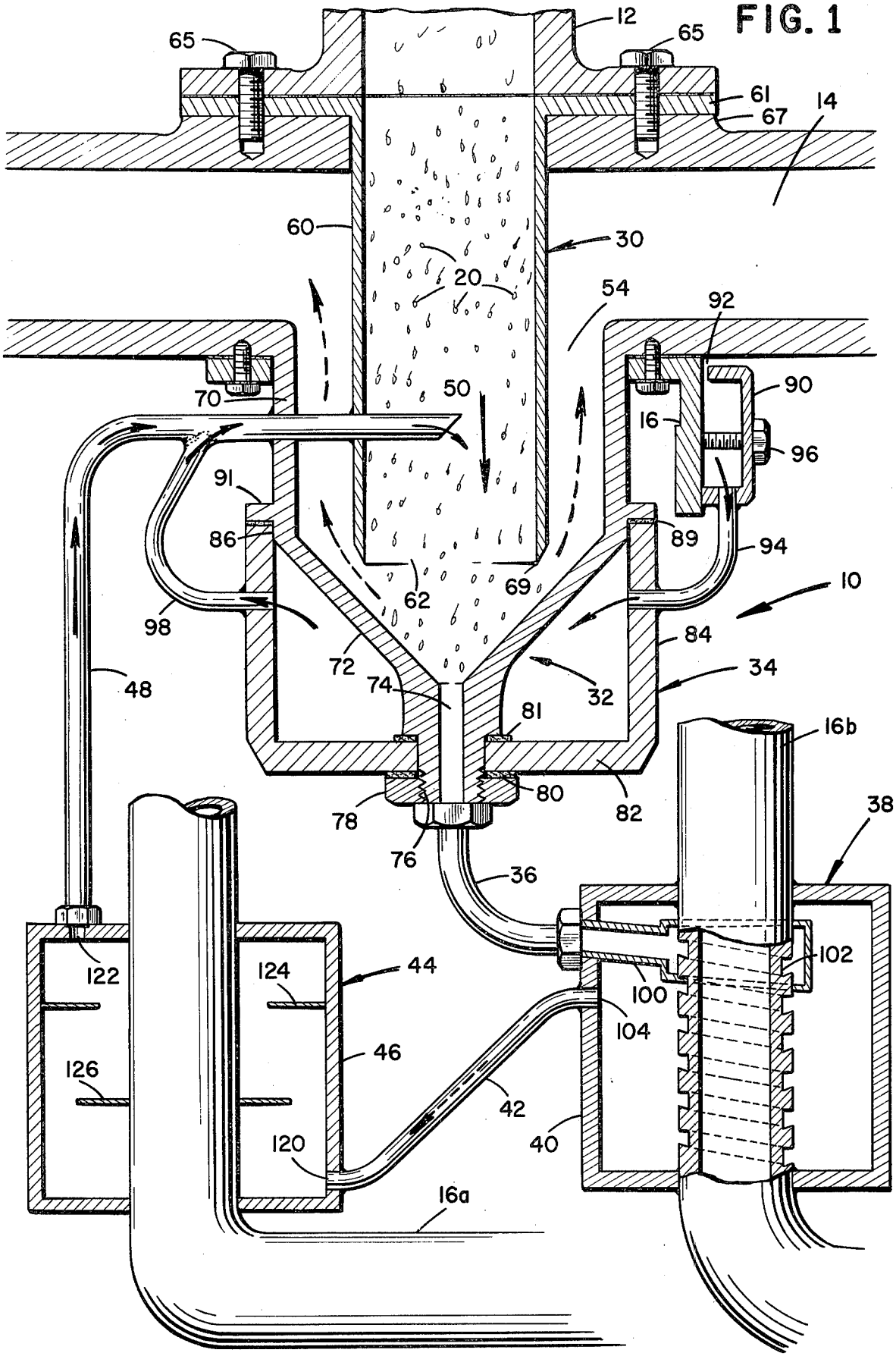
FIG. 1 is a schematic representation of an apparatus for use in an engine in accordance with the teachings of the present invention.

Shown in FIG. 1 is an apparatus for vaporizing unvaporized fuel, such as fuel heavy ends. The apparatus is denoted generally by the reference numeral 10 and is illustrated as associating with a carburetor represented at 12. The carburetor 12 may be of the conventional type in which air travelling at high velocity past a fuel intake jet results in a fuel-air mixture for injection into an intake manifold 14 of an internal combustion engine. An engine exhaust pipe is schematically illustrated at 16, having portions 16*a* and 16*b* which will be discussed in greater detail below.

Because the fuels for internal combustion engines contain components having various molecular weights, some of the fuel exits carburetor 12 without being vaporized. Related to this is the problem of recondensation of the same portions of the fuel. Such unvaporized fuel is likely to be constituted by heavy ends, and can be seen in FIG. 1 by droplets 20. As above discussed, this unvaporized fuel, or heavy ends, is an undesirable component of the fuel-air mixture entering engine intake manifold 14, because such droplets 20 do not readily burn in the combustion chambers.

Removal of undesirable droplets 20 from the fuel-air mixture entering intake manifold 14 is effected by the inventive apparatus 10. Apparatus 10 comprises a carburetor extension 30 attached to the carburetor base and which is designed to deliver droplets 20 to a collecting funnel 32. Collecting funnel 32 is surrounded by a heat riser 34 similar to the known heat riser used in conventional engines. Heat riser 34 is supplied with air heated by the exhaust/manifold through conduit 94, as will be explained below. From collecting funnel 32, the fuel droplets 20 flow through a first conduit 36 and into a first stage heater 38 comprising a heater box 40 surrounding the hottest accessable portion of engine exhaust pipe/portion 16*a*. As shown in FIG. 1, droplet flow is denoted by solid arrows and vapor or gas flow is denoted by dashed arrows. The fuel droplets are vaporized in first stage heater 38 in a manner to be described below. Fuel which is vaporized in first stage heater 38 flows through a second conduit 42 and into a second stage heater 44 comprising a heater box 46 surrounding a region of exhaust pipe/portion 16*a*. While the vapor exiting second stage heater 44 may be fed to still further heaters, only two are shown in FIG. 1. From heater 44, the vaporized fuel flows through a third conduit 48 and into the carburetor extension 30 through a jet nozzle 50. Substantially all of the fuel exiting nozzle 50 will be vaporized, yet some of the fuel may condense prior to reaching intake manifold 14. These condensed droplets are recycled as shown by solid arrows until vaporized.

As can be seen from FIG. 1, the collecting funnel 32 is in communication both with the outlet of the carburetor 12 and with the intake manifold 14. Therefore, two fuel paths are defined. The first is from the carburetor extension 30 to the intake manifold 14; vaporized fuel from the carburetor 12 and from nozzle 50 takes this path. The second is from extension 30 to the funnel 32; unvaporized and condensed fuel from carburetor 12 and nozzle 50 takes this path. As can be seen, the vaporized fuel travels to the intake manifold 14 through a passage 54 defined between carburetor extension 30 and collecting funnel 32.

the carburetor extension 30 comprises a tubular body 60 having an integral flange 61 at one end which associates with a flange 12 of the carburetor and which is mounted at boss 67 of the intake manifold 14 by bolts 65. A knife edge 69 is provided at the lower end of the tubular body 60, remote from flange 61. The knife edge 69 prevents fuel from collecting on the bottom end of the extension 30. The outlet end of the extension 30 is shown at 62. Nozzle 50 is located within extension 30 so that the fuel-air mixture flowing through extension 30 develops a suction nozzle 50, thereby drawing the vaporized fuel through the conduits of the system.

The collecting funnel 32 takes the form of a cylindrical section 70 surrounding carburetor extension 30 and converging section 72 downstream of the outlet 62. Fuel droplets collected in collecting funnel 32 flow through the converging section 72 under the influence of gravity and whatever dynamic forces are developed at outlet 62. A fluid or droplet trap 74 is defined at the bottom section 72. Trap 74 is associated with conduit 36 and heat riser 34 in a fluid-tight fashion, as by threads 76, nut 78 and gaskets 80 and 81 as illustrated in FIG. 1. As can be seen, gasket 81 is held between the base 82 of heat riser 34 and a shoulder of the trap section 74.

The heat riser 34 surrounds the converging section 72 of the collecting funnel 32, and comprises the base 82 to which trap 74 is attached and sides 84 to which the cylindrical section 70 of funnel 32 is attached, as shown at 86. Another gasket 89 is employed to ensure a fluid-tight joint between the/sides of defined riser 34 and a shoulder 91 defined integral with the collecting funnel 72.

Figure 4:
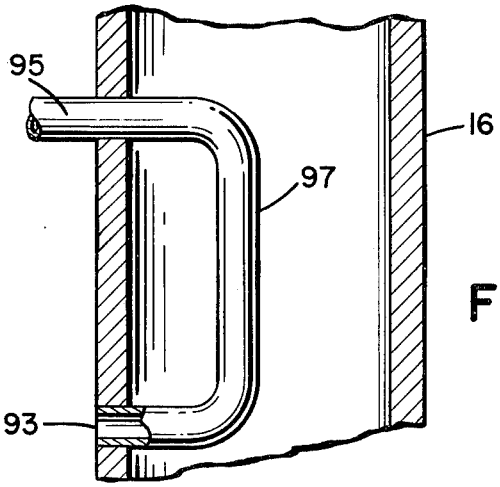
FIG. 4 illustrates a mechanism for transferring heat from an exhaust pipe to a heat riser, useful in the apparatus of the present invention.

Heat for the heat riser 34 is supplied, if necessary, by a heat source or collector comprising a cup 90 secured to the engine exhaust manifold 16 by means of a bolt 96. Ambient air flows into cup 90 through openings 92 between the cup and the exhaust manifold, and is trapped in cup 90. The trapped air is heated by the exhaust manifold and flows out of the cup through air conduit 94 into heat riser 34. The heated air from the heat source flows around collecting funnel 32 and out of the heat riser 34 through air conduit 98 into fuel conduit 48. In some applications, it may be unnecessary to add heat to cup 90. In such case, the conduits 94 and 98 would be disconnected. FIG. 4 shows an alternative embodiment of the heat collecting mechanism. There, air conduit 95 is connected to the atmosphere through opening 93. The path between conduit 94 and opening 92, in the form of conduit 97, is positioned inside exhaust manifold 16 by means of a bolt 96. Ambient air flows into cup 90 through openings 92 between the cup and the exhaust pipe, and is trapped in cup 90. The trapped air is heated by the exhaust pipe and flows out of the cup though air conduit 94 into heat riser 34. The heated air from the heat source flows around collecting funnel 32 and out of the heat riser 34 through air conduit 98 into fuel conduit 48.

The heat riser 34 thus serves as a pre-heater for the fuel droplets entering the recirculating assembly 10. By applying heat to the fuel droplets in several stages, as is the case in the preferred embodiment of the invention, a high degree of control over the heat application can be accomplished. Importantly, the temperature of each stage of such a multistage heater system is lower than the temperature of a single stage system. Therefore, the undesirable hot spots of known atomization systems can be eliminated.

A further advantage is brought about by the inventive apparatus as a result of the air flowing into conduit 48 from the heat riser 34 being heated. The heated air passing from jet 50 into the carburetor outlet enhances the combustion efficiency of the engine by /supplying hot fuel vapors to the fuel-air mixture entering manifold 14. In addition, the highly enriched heated air added to the vapor flow in conduit 48 acts as a final stage heating point to maintain vapor temperature and to add heat to the vapor flowing out of jet 50. Such heat addition replaces any heat lost by the fluid while flowing in conduit 48 from the second heater stage 44. The air conduits 94 and 98 can be designed to provide any desired temperature air to/the fuel conduit 48, as for example, by adding heaters or insulation.

The vaporization of droplets 20 initiated by the heat riser 34 is continued in the first stage heater 38. The droplets flowing into the heater stage 38 from conduit 36 are transferred by an extension 100 of conduit 36 to a groove 102 /surrounding in the outer surface of engine exhaust pipe portion **16*b*. Groove 102 resembles a screw thread in that it is continuous around the outer surface of pipe /portion 16*b* for a preselected length of that pipe. However, to maintain the liquid fuel in the groove 102, the bottom surface is tapered upwardly so as to define a trough. Fluid flows in groove 102 around the exhaust pipe /portion 16*b*, thus being heated thereby. Gravity results in the liquid fuel flowing downwardly around groove 102, and the pressure gradients developed by jet 50 add to uniform flow in groove 102. The unvaporized droplets remain in groove 102 until vaporized, at which time the vapor fills the chamber defined by the first stage heater 38. Vapor produced in first stage heater 38 flows through exit port 104 and into fuel conduit 42.**

All of the unvaporized fuel entering groove 102 should be vaporized in the first stage heater 38.

Figure 2:
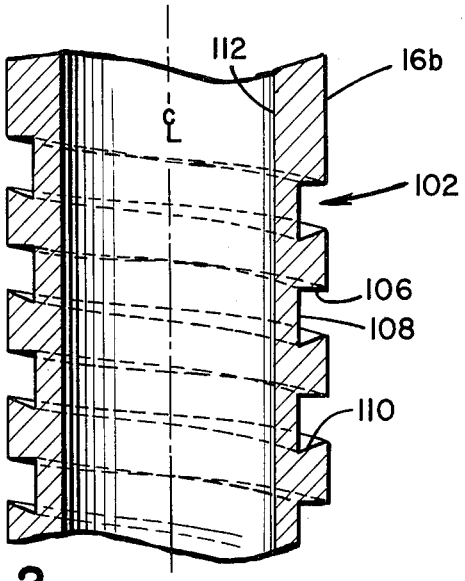
FIG. 2 illustrates a mechanism for transferring heat from an engine exhaust pipe to unvaporized fuel in accordance with the teachings of the present invention.

The groove 102 is best shown in FIG. 2 as having a modified square shape. Top face 106 is essentially perpendicular to the longitudinal axis of exhaust pipe 16 and back face 108 is essentially parallel to the pipe centerline. Bottom face 110 of the groove is skewed with respect to face 108 thereby forming a V-shaped trough in the groove. This trough holds liquified fuel in groove 102 forcing the fuel to remain in intimate contact with the hot exhaust of pipe /portion **16*b*. Therefore, the spiral groove 102 serves to maintain the fuel in contact with the exhaust pipe 16 and to increase the time the liquid fuel is in contact with the pipe 16*b* thus maximizing the time for vaporizing the fuel. The groove 102** also minimizes the effects of hot spots in the inventive system.

Figure 3:
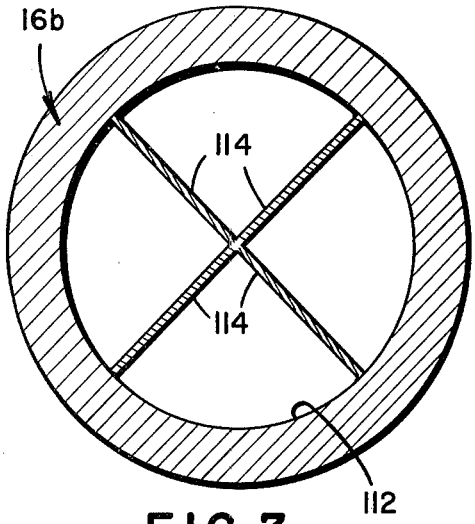
FIG. 3 illustrates a heat conductor for transferring heat from an engine exhaust to the walls of the engine exhaust pipe.

The heat transfer rate between the hot exhaust gases flowing in pipe /**16*b* and the unvaporized fuel flowing in groove 102 can further be increased by radiating vanes such as those illustrated in FIG. 3. Vanes 114 are shown as extending across the pipe /16*b* and intersecting at the centerline of the exhaust pipe. The vanes serve as heat transfer paths between the exhaust gases and the inner wall 112 of exhaust pipe 16*b*. It is contemplated that the vanes extend the entire length of the heater 38. A similar vane structure can be used in the second stage heater. If desirable to control the transfer rate between the hot exhaust gases in exhaust pipe 16*b* and the unvaporized fuel flowing in groove 102,** the vanes can be specially shaped or of lengths other than those of their respective heaters.

Fuel vapor developed in first stage heater 38 flows through fuel conduit 42 and into second stage heater 44. It is understood that while only two are shown, any number of heater stages can be used. Fuel vapor flows into the second stage heater 46 through an opening 120 in conduit 42 which may be equipped with an orifice to control the vapor flow into the heater box 46. The vapor flows through the heater box 46 which again effects contact between the vapor and the exhaust pipe **16*a*. However, as is evident from FIG. 1, the second heater stage 46 has no groove such as groove 102 of the first heater stage. Reheated vapor flows out of the heater box 46 through an exit port 122 and into the fuel conduit 48. A plurality of surfaces such as baffles 124 and fins 126 may be provided to control the vapor flow and/or the heat transfer rate. Preferably, the second stage heater 44 is positioned near jet 50** to maximize heat transfer.

To further compensate for heat lost by the vaporized fuel, fuel conduits 36, 42 and 48 can be insulated. Flow through conduits 36 and 42 is in a downward direction thereby taking advantage of gravity. The flow in conduit 48 may be upward due to the proximity thereof to the jet 50. The flow rate in fuel conduits 36, 42 and 48 can also be adjusted to produce the most efficient vaporization of the fuel.

In a preferred embodiment of the invention, the cross-sectional area of conduits 36 and 48 is four times that of the carburetor jet cross-sectional area. Conduit 42, on the other hand, has a cross-sectional area sixteen times that of the carburetor jet cross-sectional area. Furthermore, the cross-sectional area of the outlet 62 is equal to that of the carburetor base area, and to that of passage 54.

From the foregoing, it should be evident that the inventive apparatus 10 can provide significant improvement in the performance of an internal combustion engine. By improving the quality of the fuel-air mixture entering the engine intake manifold, significant power increases may be realized without a corresponding increase in the size of the engine. At the same time, the substantially total atomization of fuel improves combustion efficiency thus greatly increasing the miles per gallon ratio important to modern-day automobiles. Furthermore, by injecting a properly adjusted fuel-air mixture into the engine intake manifold, engine vacuum spark advance may be reduced.

Another significant advantage of the engine designed in accordance with the present invention is the reduction in pollutants exhausted by the engine. Internal combustion engines equipped with the inventive apparatus 10 produce exhausts having negligible levels of hydrocarbons and carbon monoxide. The invention also reduces the level of nitrogen oxides such as nitric or nitrous oxide in te exhaust of an engine. The apparatus of the present invention inherently accomplishes substantial pollutant reduction without the necessity for pollution devices such as those used with existing automobile engines. As discussed above, fuel droplets in the fuel-air mixture inhibit combustion in the engine. To compensate for the presence of fuel droplets, many engines operate at high temperatures. As the aspirated air is composed of roughly 78 percent nitrogen these high temperature explosions generate dangerous oxides of the nitrogen. The invention avoids the production of these pollutants since the combustion temperatures of an engine designed in accordance with the present invention are below those levels at which oxides of nitrogen are produced.

Thus it should be apparent that the apparatus of the present invention not only increases engine efficiency in the way of engine performance, but also develops an exhaust containing only minimal pollutants, hence avoiding the necessity for external pollution control devices.

The operation of the inventive apparatus is as follows. Unvaporized fuel-ends which are in the form of droplets 20 are separated out of the fuel-air mixture and are collected in collecting funnel 32. The collecting droplets are pre-heated in heat riser 34, and flow through conduit 36 into first stage heater 38. In heater 38, the liquid fuel is carried in groove 102 which transfers heat from exhaust pipe /portion **16*b* to the liquid fuel. The fuel is maintained in the groove 102 until the heat from exhaust pipe /portion 16*b* has vaporized the droplets. The vaporized fuel then flows through conduit 42 into the second heater stage 44 positioned in close proximity to carburetor extension 30, so that heat transfers from pipe /portion 16*a* to the vaporized fuel. In this manner, the vaporized fuel is reheated prior to flowing through conduit 48 and out of jet 50 into the carburetor exhaust stream. Finally, the vaporized fuel is directed to the engine intake manifold 14.** The method can also include placing a plurality of heater stages at strategic points throughout the engine, such as in close proximity with an engine cylinder. Such placement will assure a thoroughly vaporized fuel in the fuel-air mixture entering any engine cylinder, even those cylinders located some distance from the apparatus and/or engine carburetor. That fuel which is not vaporized, or that fuel which condenses, is recirculated through the inventive fuel feed system.

Figure 5:
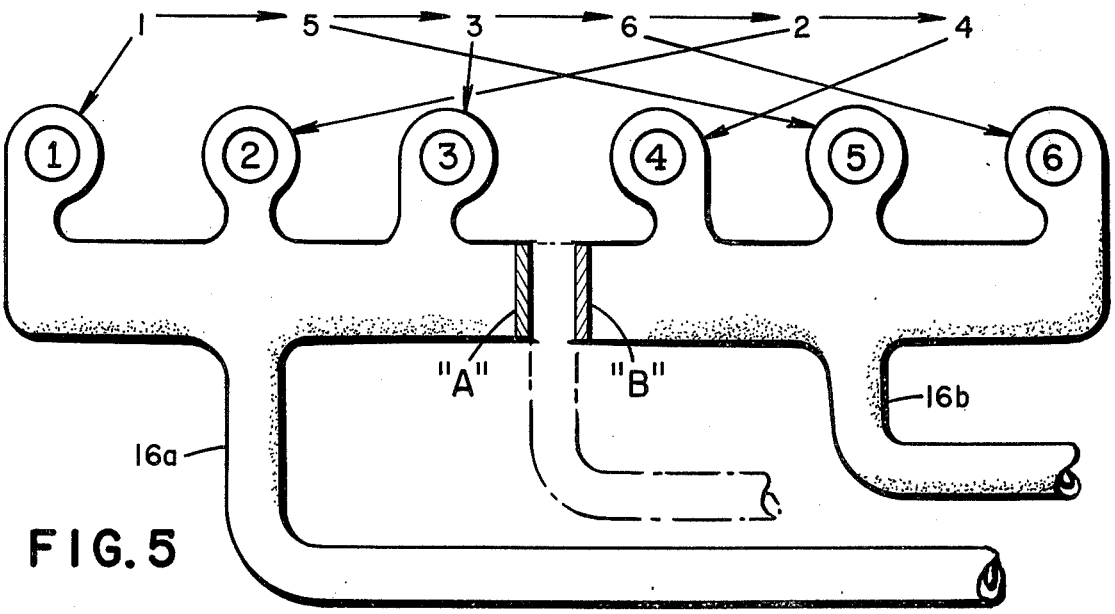
FIG. 5 is a schematic representation of a firing sequence in a split-manifold engine utilizing the apparatus embodied in the present invention.

The vaporizing apparatus 10 is conveniently adapted for use in the aforementioned dual exhaust system engine. For purposes of illustration, the following discussion will be based upon a six-cylinder engine having an exhaust manifold divided into a front section of three cylinders and a rear section of three cylinders. With such an engine, exhaust pipe portion **16*a* is connected to the front three cylinders through the forward portion of the exhaust manifold, and portion 16*b* is connected to the rear three cylinders. In a six cylinder engine having a firing order of 1-5-3-6-2-4, successive exhausting will thereby occur in alternate manifold sections. Thus, cylinder 1 will exhaust into portion 16*a*, cylinder 5 into portion 16*b*, then cylinder 3 will exhaust into portion 16*a*, and so forth. Successive exhausting into alternate manifold sections prevents back pressure developed in a front cylinder from acting upon (or through) an open back cylinder exhaust valve (and vice versa). Such successive exhausting therefore results in the efficient scavenging of all cylinders; and as is known, such efficient scavenging improves engine power and efficiency. A single full length exhaust manifold can be easily converted into the dual exhaust manifold configuration shown in FIG. 1 by cutting the manifold at the center, capping the ends thus opened and adding appropriate exhaust pipes. Such a dual manifold is shown in FIG. 5 with the original manifold shown in phantom lines. A 1-5-3-6-2-4 firing sequence is also illustrated in FIG. 5.**

Obviously, numerous modifications and variations of the present invention are possible in light of the above teachings. For example, the present invention may include electric heaters for supplementing the heat added by the engine exhaust during cold engine start-up. Or, if the engine temperature is low even long after start up, it is possible to add heat to appropriate portions of the engine to improve performance. In addition, it has been discovered that with the high-expansion ratio engine, the lower side of the engine block runs quite cool. Therefore, to maintain the entire block at optimum temperature, water from the top of the head may be extracted and recirculated into the input side of the water pump for subsequent entry into the head. Other modifications are possible. It is therefore understood that, within the scope of the appended claims, the invention may be practiced otherwise than as specifically described.

I claim:

1. An apparatus for vaporizing fuel prior to introduction into the combustion chambers of an engine, in combination with said engine, the apparatus comprising: a carburetor extension for receiving the fuel-air mixture from a carburetor; separator means for separating the vaporized fuel from the fuel droplets prior to entry into the combustion chambers, said separator means including flow reversal means for diverting the flow direction of vaporized fuel by on the order of 180° while not substantially affecting the flow direction of fuel droplets; collecting means for collecting the fuel droplets, said collecting means being positioned downstream of said carburetor extension; a plurality of heater stages for heating said fuel droplets, said heater stages including at least a first heater stage positioned downstream of said carburetor extension and a second heater stage positioned downstream of said first heater stage; a first conduit for connecting said collecting means to said first heater stage for delivering fuel droplets from said collecting means to said first heater stage; a second conduit for connecting said first heater stage to said second heater stage for delivering vaporized fuel from said first to said second heater stage; and a third conduit for connecting said second heater stage to said carburetor extension for delivering reheated vaporized fuel to said carburetor extension.

2. The apparatus of claim 1, wherein the carburetor has a jet of a predetermined cross-sectional area, and wherein said first and third conduits have cross-sectional areas four times the cross-sectional area of said jet.

3. The apparatus of claim 1, wherein the carburetor has a jet of a predetermined cross-sectional area, and wherein the cross-sectional area of said second conduit is 16 times the cross-sectional area of said jet.

4. The apparatus of claim 1, including a jet nozzle positioned on the end of said third conduit.

5. An apparatus for use with an internal combustion engine, for ensuring complete combustion of the fuel-air mixture introduced to the combustion chambers of an engine, the apparatus comprising: means for feeding the fuel-air mixture to a separation site; means at said separation site for diverting the flow direction of that portion of the fuel-air mixture which comprises vaporized fuel through on the order of 180° without substantially affecting the flow direction of that portion which comprises fuel in an unvaporized state, for thereby separating out of said fuel-air mixture, that portion which comprises fuel in an unvaporized state; means for delivering that portion of the fuel-air mixture which comprises vaporized fuel to the engine's combustion chambers; heater means for heating that portion of the fuel-air mixture which comprises unvaporized fuel so that at least a portion of the same is vaporized; and means for delivering the heated vaporized fuel-air mixture to said separation site.

6. the apparatus of claim 5, including a heat riser surrounding said separation site.

7. The apparatus of claim 6, including a source of heated air connected to said heat riser.

8. The apparatus of claim 7, wherein said source of heated air comprises a collection means associated with the exhaust of the engine.

9. The apparatus of claim 8, including air conduits for connecting said heat riser to said third conduit.

10. The apparatus of claim 5, wherein said heater means includes first and second heater stages having first and second stage heat transfer means for transferring heat from the engine exhaust pipe to said fuel-air mixture.

11. The apparatus of claim 10, wherein said first stage heat transfer means comprises a groove positioned around the outer periphery of said engine exhaust pipe, and means for transferring said fuel droplets from said first conduit to said groove.

12. The apparatus of claim 10, wherein said second stage heater comprises a plurality of heat transmitting surfaces to deliver heat from the exhaust gases to the fuel-air mixture.

13. The apparatus of claim 11, wherein said groove is substantially square shaped.

14. The apparatus of claim 13, wherein said groove has a V-shaped trough at the bottom thereof.

15. The apparatus of claim 10, including heat conducting plates positioned inside said engine exhaust pipe to transmit heat from the exhaust gases to the fuel-air mixture.

16. The apparatus of claim 5, wherein said separation site is in fluid communication with an engine intake manifold.

17. The apparatus of claim 5, wherein said engine is an internal combustion engine.

18. The apparatus recited in claim 5, wherein the engine is an internal combustion engine; and wherein the expansion ratio of said engine is in excess of its compression ratio.

19. An apparatus for ensuring complete vaporization of fuel prior to entry into the intake manifold of an engine, the apparatus comprising: a carburetor having an outlet end through which a fuel-air mixture exits; a carburetor extension for separating vaporized fuel from unvaporized fuel droplets; means for reversing the flow direction of the vaporized fuel by on the order of 180° and for delivering the vaporized fuel to said intake manifold; a heater for vaporizing said unvaporized fuel droplets; means for delivering said unvaporized fuel droplets to said heater; and means for introducing fuel vaporized by said heater to said carburetor extension.

20. A method of vaporizing fuel prior to introduction into the combustion chambers of an engine, the method comprising the steps of: separating vaporized fuel from fuel droplets prior to entry into the combustion chambers by reversing the flow direction of the vaporized fuel by on the order of 180° without affecting the flow direction of fuel droplets; collecting the fuel droplets in a collecting means; preheating said fuel droplets in said collecting means; directing said fuel droplets into a first heater stage; vaporizing said droplets in said first heater stage; directing said vaporized fuel into a second heater stage; reheating said vaporized fuel in said second heater stage; and directing said vaporized reheated fuel into the fuel-air mixture exiting the carburetor of said engine.

21. The method of claim 20, wherein the step of vaporizing said fuel droplets in said first heater stage includes effecting contact between said fuel and the hot exhaust pipe of said engine.

22. The method of claim 20, wherein the step of reheating said vaporized fuel in said second heater stage includes effecting contact between said vaporized fuel and the hot exhaust pipe of said engine.

23. The method of claim 20, wherein the step of preheating said fuel droplets includes passing heated ambient air around said collecting means.

24. The method of claim 23, wherein the step of preheating said fuel droplets further includes the steps of: removing said heated air from said collecting means; and introducing said heated air removed from said collecting means into the flow of vaporized fuel into said carburetor.

25. The method of claim 20, wherein said second heater stage is in near proximity to said carburetor.

26. The method of claim 21, wherein the contact between said fuel droplets and the hot engine exhaust pipe comprises the steps of: transferring said fuel droplets to a groove positioned on the periphery of said exhaust pipe; and maintaining said fuel in said groove until said fuel is vaporized.

27. The method of claim 20, wherein the step of introducing said vaporized fuel into the mixture exiting said carburetor includes directing said vaporized fuel through a jet nozzle.

28. A method of ensuring complete combustion of the fuel-air mixture introduced to the combustion chambers of an engine, the method comprising: feeding the fuel-air mixture to a separation site; separating out of said fuel-air mixture, that portion which comprises fuel in an unvaporized state by diverting the flow direction of that portion of the fuel-air mixture which comprises vaporized fuel through substantially 180° without substantially affecting the flow direction of that portion which comprises fuel in an unvaporized state; delivering that portion of the fuel-air mixture which comprises vaporized fuel to the engine's combustion chambers; heating that portion of the fuel-air mixture which comprises unvaporized fuel so that at least a portion of the same is vaporized; and delivering the heated vaporized fuel-air mixture to said separation site.

29. The method recited in claim 28, wherein the engine is an internal combustion engine; and wherein the expansion ratio is in excess of the compression ratio of said engine.

* * * * *